US006561318B1

(12) United States Patent
Lamb

(10) Patent No.: US 6,561,318 B1
(45) Date of Patent: May 13, 2003

(54) EMERGENCY MANUAL ELEVATOR DRIVE

(75) Inventor: Miles P. Lamb, Chester, NJ (US)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 09/952,229

(22) Filed: Sep. 14, 2001

(51) Int. Cl.[7] ..... B66B 11/08
(52) U.S. Cl. ..... 187/263; 187/306
(58) Field of Search ..... 187/263, 306, 187/311, 312, 288, 377, 414

(56) References Cited

U.S. PATENT DOCUMENTS

| | | | | | |
|---|---|---|---|---|---|
| 1,373,112 | A | * | 3/1921 | Evangelist | 187/266 |
| 4,533,021 | A | * | 8/1985 | Orden | 187/290 |
| 5,680,911 | A | * | 10/1997 | Wang | 187/263 |
| 5,713,433 | A | * | 2/1998 | Wang | 187/263 |
| 5,971,109 | A | * | 10/1999 | Aulanko et al. | 187/263 |
| 6,273,216 | B1 | * | 8/2001 | Kocher et al. | 187/263 X |
| 6,464,043 | B2 | * | 10/2002 | Wang | 187/263 X |

FOREIGN PATENT DOCUMENTS

| | | | | | |
|---|---|---|---|---|---|
| JP | 3-133888 | A | * | 6/1991 | 187/298 |

* cited by examiner

*Primary Examiner*—Eileen D. Lillis
*Assistant Examiner*—Thuy V. Tran
(74) *Attorney, Agent, or Firm*—Schweitzer Cornman Gross & Bondell LLP

(57) ABSTRACT

An emergency drive system for elevators allows manual raising and lowering of the elevator in an emergency condition when an emergency brake has been applied to a rotating member of the elevator drive system. A linkage element is pivotally mounted to the brake, and carries a manual drive member having a drag bearing and a pair of guide rollers. A drive line passes about the drive member, guide rollers and a hand crank. Operation of the hand crank creates a tensional imbalance in the drive line, pivots the linkage member to engage the manual drive member with the rotary member. The increased drag to crank rotation resulting from the engagement causes the linkage element to pivot about the manual drive member, backing the brake away from the rotating member and allowing the rotating member to be turned by the manual drive member. The device is self-regulating, permitting only sufficient release of the brake to cause a slow rotation of the rotating member and the elevator car motion.

7 Claims, 4 Drawing Sheets

EMERGENCY MANUAL ELEVATOR DRIVE

The present invention relates to a new and improved apparatus to allow the remote actuation of an elevator traction drive sheave to permit manual control of an elevator car in the event of an emergency.

BACKGROUND OF THE INVENTION

Conventional elevator systems typically include a motor installation having a motor-operated transmission which raises and lowers one or more cables to which the elevator car is affixed. In the event of an emergency condition, a friction brake is automatically engaged which bears against a rotating element of the transmission, such as a main cable sheave, and locks the sheave in position, preventing further cable and thus elevator car motion. While such devices provide a positive and effective stop against car motion, it is often difficult to release the brake in a controlled manner and under controlled conditions to allow the cab to be manually raised or lowered, such as for evacuation purposes.

U.S. Pat. No. 5,680,911 discloses an elevator emergency release device in the form of a pull cable which pivots an application rod, causing engagement of a manually-operated gear unit to mesh with a corresponding gear of the elevator transmission. At the same time, the motion of the application rod causes the disengagement of the previously-applied emergency brake. Subsequent manual operation of a second cable causes the manual rotation of the transmission spindle, allowing the elevator car to be raised or lowered as required. Such a device requires the manual operation of both cables, both of which are typically located outside the elevator car. The presence of multiple cables make it inconvenient or difficult to operate, particularly when a car occupant is faced with an emergency situation. Further, the requirement that the actuating cables be operated by a car occupant reaching outside the car with both arms can be disconcerting.

It is accordingly a purpose of the present invention to provide an emergency elevator manual drive unit which is operable through a single control mechanism.

A further purpose of the present invention is to provide a device for manually releasing an elevator drive brake and subsequently moving the elevator which can be employed for use either by a car occupant or by personnel at the elevator hoistway.

Yet a further purpose of the present invention is to provide a device for the failsafe manual operation of an elevator, such as in emergency conditions, by which a single, hand-operated unit both releases the emergency brake and allows for the raising or lowering of the elevator car in a safe and controlled manner.

BRIEF DESCRIPTION OF THE INVENTION

In accordance with the foregoing and other objects and purposes, an emergency manual elevator drive device constructed in accordance with the present invention comprises a friction brake adapted for engagement with a rotating member of an elevator transmission in an emergency situation in a manner known in the art. A linkage element is pivotally mounted to the, brake and supports a manually-operable drive roller. Means are provided for applying a force to the linkage element to allow the drive roller to be pivoted into contact with the elevator drive member when the drive member is braked by the friction brake during an emergency condition, and to pivot the friction brake away from the drive member once the drive roller is in contact with the drive member, allowing the drive member to be rotated by the manual drive roller to raise or lower the car.

In a preferred embodiment the force is applied to the linkage element through a pulley or gear having a drag bushing by which the drive roller is mounted to the linkage element. Rotational force is applied to the drive roller through a drive belt, rope or chain driven by a hand crank, located for example at the elevator car. The drag bushing causes a force imbalance to be generated in the chain and applied to the linkage element, causing pivoting of the linkage arm first about the brake pivot point to engage the drive roller with the drive member and thereafter, when the drive roller is engaged with the drive member to pivot, about the drag bushing and drive roller to back the brake away from the drive member. With the friction brake partially disengaged from the drive member, the manual drive roller remains in engagement with the drive member, turns the drive member, and allows the elevator car to be moved in a controlled manner.

The system is self-regulating, as the force imbalance applied by the belt or chain cannot exceed that which is required to back the brake from the drive member only enough to allow the drive member to be driven by the manual drive roller and a dynamic equilibrium to be established. Continued manual operation of the crank is required to maintain the equilibrium. Any release of the crank removes the applied force imbalance and causes the brake to return to its normal engaged position, stopping motion of the drive member and the elevator car, and disengages the manual drive roller from the drive member.

BRIEF DESCRIPTION OF THE DRAWINGS

A fuller understanding of the present invention will be achieved upon consideration of the following detailed description of a preferred, but nonetheless illustrative embodiment of the invention when reviewed in connection with the annexed figures, wherein.

DETAILED DESCRIPTION OF THE INVENTION

Figure 1:
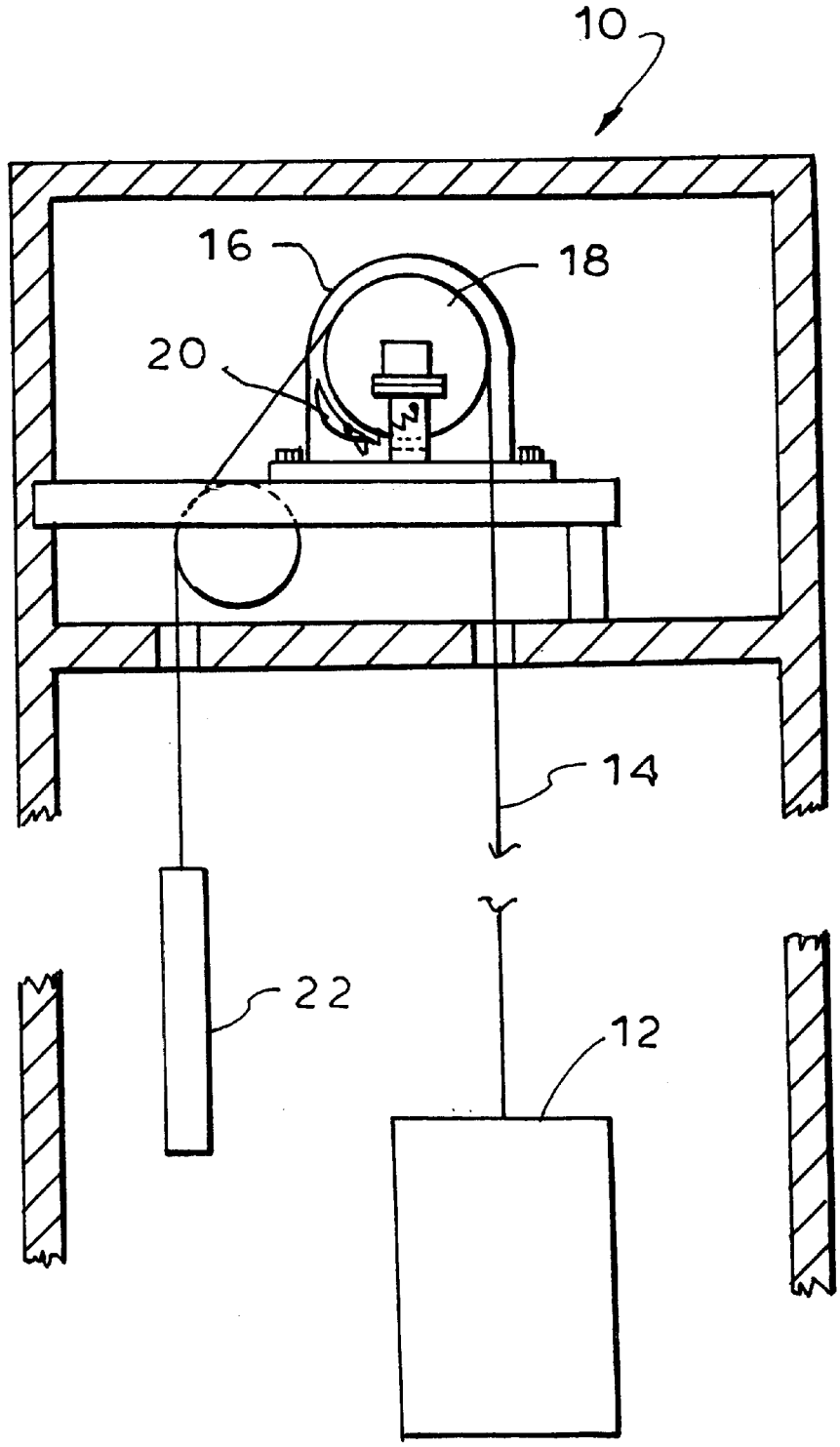
FIG. 1 is a view of a generalized elevator system with which the present invention may be employed.

With initial reference to FIG. 1, elevator system 10 includes car 12 having a lift cable 14 coupled to a drive system 16 in a drive house. As known in the art, the drive system 16 may include one or more sheaves, such as 18, for supporting the cables, for incorporation into a brake system and the like. A counterweight 22 may be provided to lessen the power needed to raise and lower the car. Friction brake 20 is provided for sheave 18, the brake 20 engaging automatically in the event of an emergency situation. With application of the brake, raising and lowering of the car 12 is prevented. In accordance with the present invention a manual drive for the sheave is provided, action and operation thereof being accomplished by manual operation of a hand crank assembly forming part of the emergency drive system. Operation of the hand crank allows the car to be raised or lowered as appropriate.

Figure 2:
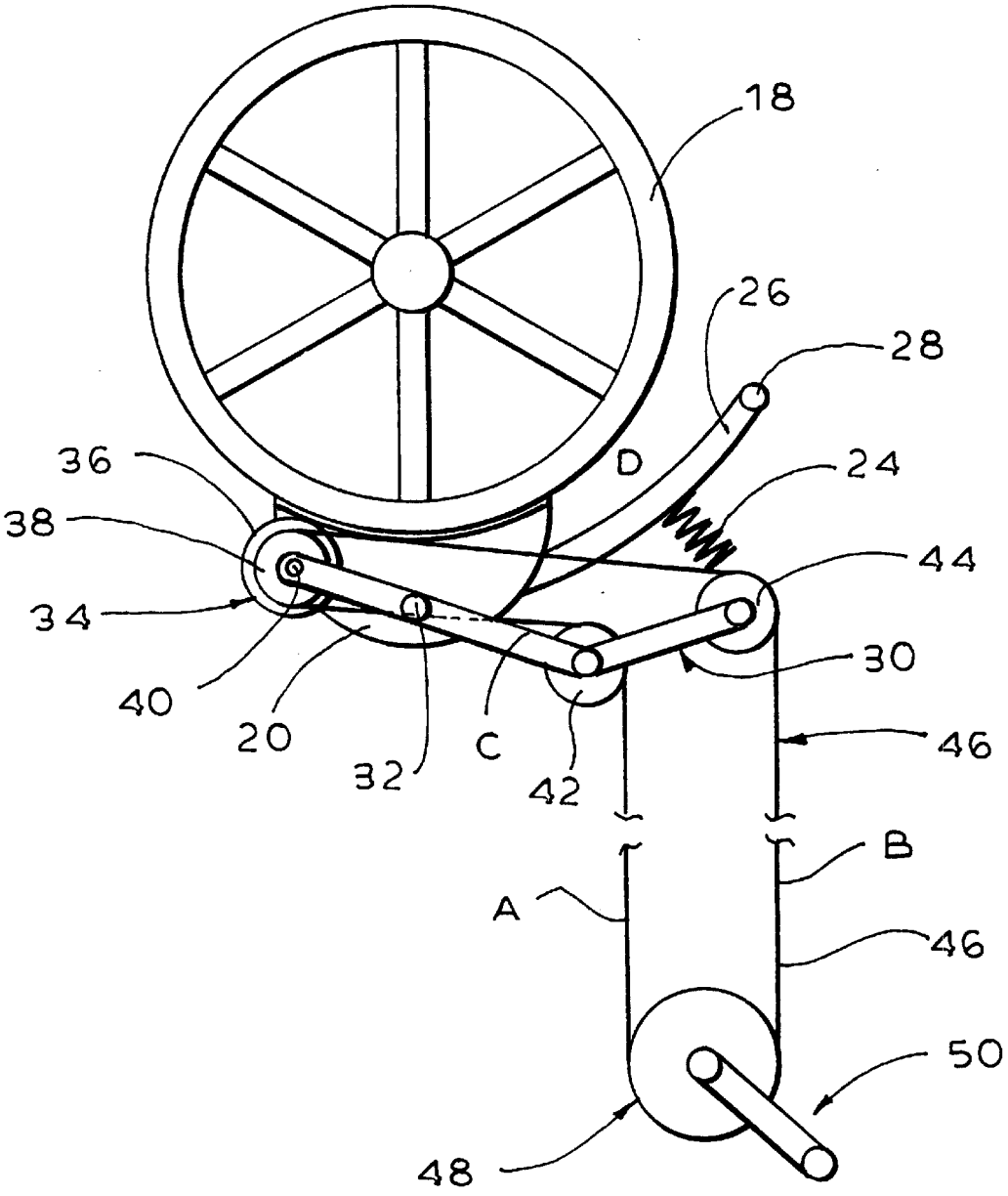
FIG. 2 is a view of a emergency drive system in accordance with the invention showing the system in the unengaged position after the elevator emergency brake has been activated.

As depicted in FIG. 2, a braked sheave 18 of the elevator drive system is provided with friction brake 20 mounted on brake arm 26 pivotly mounted to a fixed frame at pivot point 28. A brake spring 24 applies the brake against the sheave. A trigger system (not shown) releases the brake, normally held away from the sheave 18, in an emergency situation, the brake spring causing the brake to engage with the sheave to stop the car. The braked sheave 18 may be located in the drive house, as shown in FIG. 1, in which case the emergency drive system of the invention is preferably located therein and is operated at the drive house. Alternatively, the braked member or sheave may be located at the elevator car, in which case the emergency drive system may be correspondingly car-mounted and is operated from the car.

The present invention comprises an angled linkage element 30 which is pivotly affixed to the brake 20 at pivot point 32, located on a first leg of the linkage element. The distal end of the first leg of the linkage arm bears manual drive roller 34. The drive roller 34 includes a peripheral contact surface 36, such as a rubber tread, that engages the sheave 18, along with a drive pulley or gear portion 38 and a hub or bearing 40. The bearing 40 includes a drag clutch, intentionally inducing frictional resistance for the rotation of the drive roller, as will be further discussed.

A second leg of the linkage element supports a guide roller 44 at the end thereof, while a second guide roller 42 is located at the vertex of the angle formed by the two legs of the linkage element. The formed angle may be on the order of 135° degrees. Both of the guide rollers are journaled for free rotation about their respective bearing points. A drive line 46, which may be a roller chain or cable, loops about a gear or pulley 48 of hand crank assembly 50, about the first guide roller 42, around the manual drive roller 34, past second guide roller 44, and back to the hand crank assembly gear 48. As may be seen in the FIG. 2, the hand crank assembly is so positioned with respect to the linkage element, such that the segments A and B of the drive line, between the hand crank assembly and the guide rollers, are substantially perpendicular to the length of the linkage element 30, while drive line segments C and D, between the guide rollers and the manual drive roller 34, are substantially parallel to the length of the linkage element.

Figure 4A:
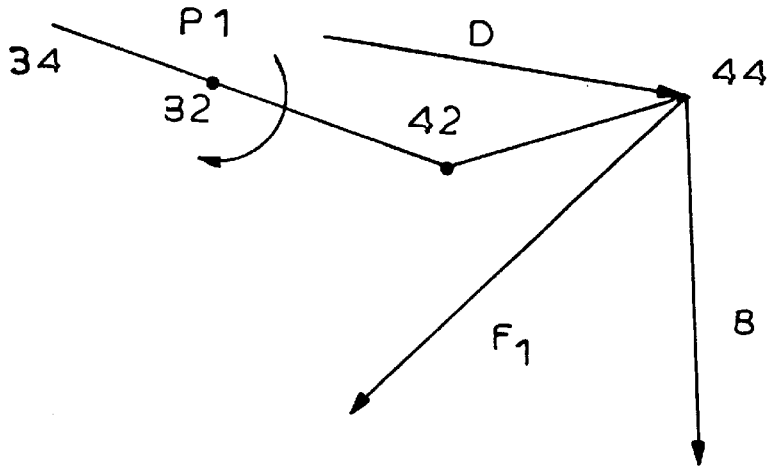
FIG. 4*a* is a force diagram depicting the action of the linkage when the hand crank is first operated.
Figure 4B:
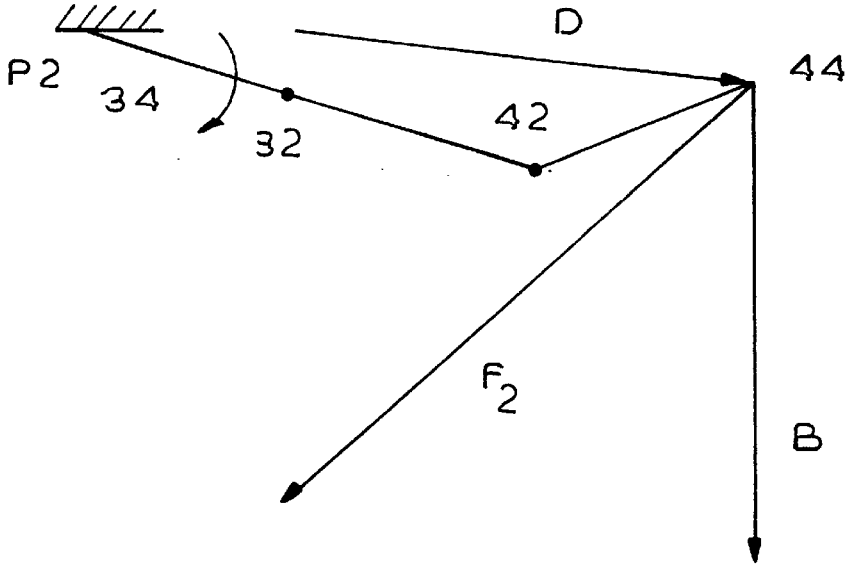
FIG. 4*b* is a force diagram illustrating operation of the system as the hand crank is continued to be operated.

In an emergency situation, with the brake 20 having been actuated and engaged with the sheave 18, and no tension being placed upon the drive line 46 by hand crank operation, the drive roller initially remains out of contact with the sheave. Maintenance of this initial position may be insured, for example, by a small bias spring (not shown) between the brake and linkage element. The bias spring further provides that inadvertent contact between the drive roller and the sheave is avoided. When manual operation of the car is required in an emergency situation, the hand crank 50 is accessed and operated. Turning the hand crank clockwise places tension in the drive line 46. Because of the frictional drag developed at the drive roller 34 by the drag clutch bearing 40, however, an initial force imbalance in the drive line is generated. This is depicted in FIG. 4*a*. As shown therein, clockwise rotation of the hand crank causes tension in drive line sections B and D, induced by the drag resistance of the bearing 40, chain sections A and C being in a slack condition. The tension in sections B and D create a resultant force F1, acting at guide roller 44. This resultant, acting at the end of a lever arm extending between a fulcrum defined by brake mounting point 32 and the end of the second leg of the linkage element, overcomes any bias maintaining the drive roller out of contact with the sheave, and rotates the linkage element clockwise about the brake mounting point/fulcrum, P1. As the linkage element pivots thereabout, drive roller 34 pivots upwardly in a clockwise arc into contact with the sheave 18.

Figure 3:
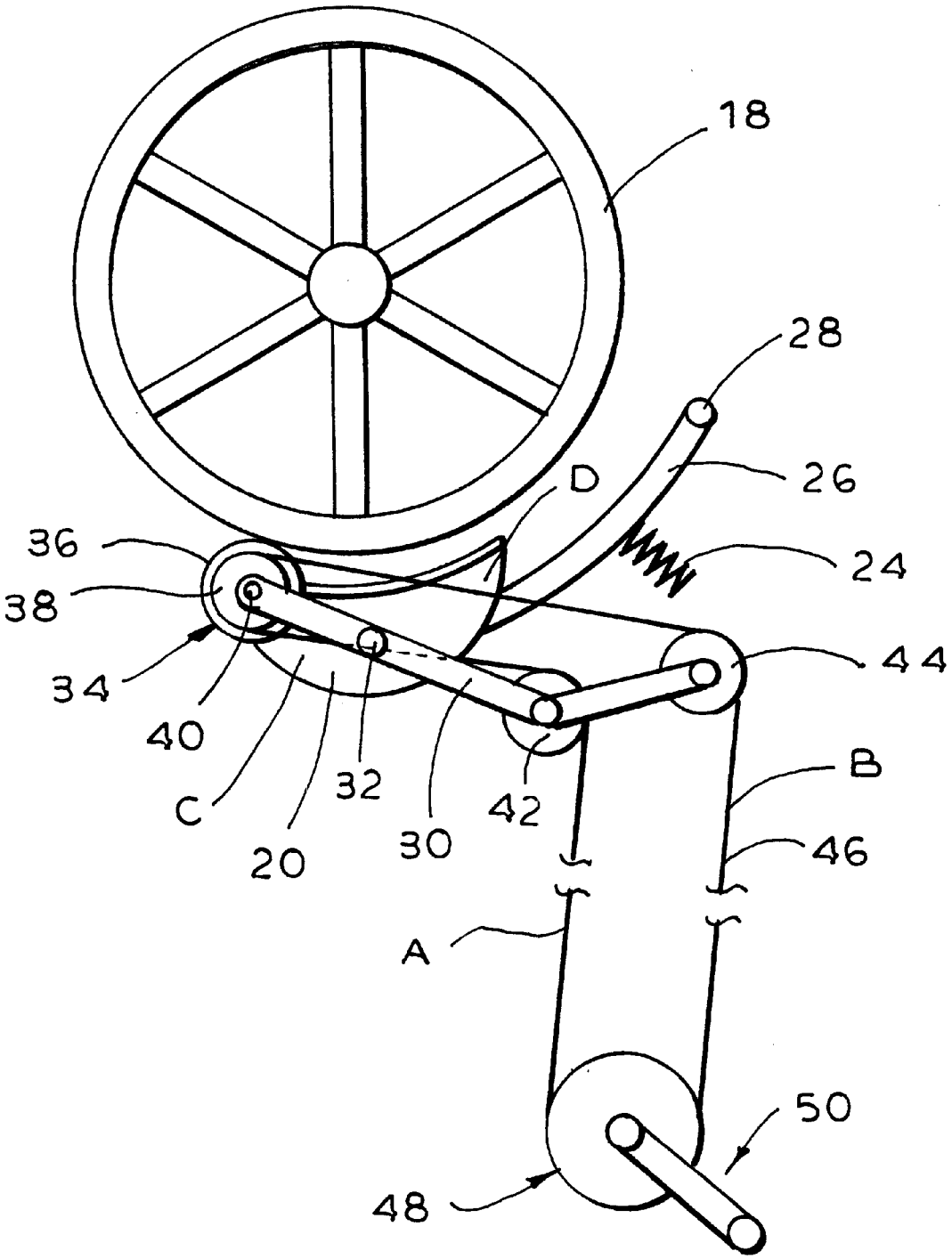
FIG. 3 is a view of the system in the fully engaged position.

FIG. 3 depicts the manual drive roller pivoted into engagement with the sheave. With the drive roller 34 now engaging the sheave 18, and the brake 20 still in contact therewith, the resistance to manual cranking increases, as any rotation by the drive line of the manual drive roller in engagement with the sheave is now resisted by the force of the applied brake 20. Greater force must then be applied to the crank. The application of a greater force level to the crank and thus to the drive roller, resisted by the applied brake, creates a greater tensional imbalance in the drive line, line sections A and C still remaining in a slack condition as the tension in sections B and D increase. Because the linkage element is no longer free to rotate further about pivot point 32 due to the contact by the drive roller with the sheave, the increasing tension in drive line sections B and D generate the greater resultant F2, as shown in FIG. 46, and causes the linkage element to rotate about the distal end of the first leg and drive roller 34, serving as pivot point P2. Because the linkage element is joined to the brake at 32, the brake pivots clockwise downwardly, away from the sheave 18, releasing the sheave and permitting the sheave to rotate, driven by the frictional contact with drive roller 34. So long as sufficient force is applied to the crank to back the brake away from the sheave, a dynamic equilibrium is established, the brake 20 remaining pivoted away from the sheave 18 just sufficiently to allow the manual drive roller to rotate and in turn cause the sheave to rotate. The needed tensional imbalance in the roller chain is maintained by the continual manual application of force to the hand crank, the sheave being driven by the drive roller and the car being raised or lowered, depending on the relationship of the sheave 18 to the car lift cable, at a controlled rate of speed.

As depicted in the Figures, operation of the manual drive occurs when the crank is turned clockwise. If the crank is turned counterclockwise, increased tension is developed in drive line sections A and C, tending to pivot the drive roller further away from the sheave. Without the increased resistance resulting from sheave contact, the user can easily determine which cranking direction is correct to move the car.

When the elevator system with which the invention is utilized includes a rotating member at the elevator car, the invention can be mounted to the car in association with a brake to engage the rotating member. In such a case the crank can be positioned behind an access panel or door to allow operation by a car occupant in an emergency situation. The crank can also be located in the car in connection with a drive house-located rotating member and brake. In such a case, however, means must be provided to accommodate the varying distance between the car and drive house, and particularly the varying length of drive line required, either by use of a follower mechanism to accommodate chain slack or through means to selectively engage the crank with a drive line running the length of the hoistway.

I claim:

1. An emergency drive system for manually operating an elevator drive system to raise or lower an elevator car, comprising:

a friction brake for engaging a drive member of the elevator drive system in an emergency condition, the brake being biased against the drive member to prevent car motion in the emergency condition;

an elongated linkage element pivotally mounted to the brake and having a manual drive roller with rotational drag means at a first side of the pivotal mount for engagement with the drive member and a pair of spaced guide rollers at a second side of the pivotal mount; and a hand crank for rotating the drive roller coupled to the drive roller by a drive line, the drive line passing around the drive roller, guide rollers and hand crank;

whereby frictional rotation drag generated at the drive roller as the drive roller is driven by turning the hand crank creates an imbalanced tension in the drive line to pivot the linkage element to engage the drive roller with the drive member and subsequently pivot the brake away from the drive member.

2. The emergency drive system of claim 1, wherein the brake comprises a brake shoe pivotally mounted to a brake arm, the linkage element being mounted to the brake at the brake shoe.

3. An emergency drive system for manually operating an elevator drive system to raise or lower an elevator car, comprising:

a friction brake for engaging a rotating drive member of the elevator drive system in an emergency condition, the brake being biased against the drive member to prevent car motion in the emergency condition;

a linkage element pivotally mounted to the brake at a first pivot point and having a manual drive roller at a first end for engagement with the drive member;

means for applying force to the linkage element for pivoting the linkage element about the first pivot point to engage the manual drive roller with drive member and for subsequently pivoting the linkage element about a second pivot point to partially disengage the brake from the drive member; and means for manually rotating the manual drive roller whereby the drive member is rotated to raise or lower the car.

4. The emergency drive system of claim 3 wherein the means for applying force to the linkage element comprises a frictional bearing for the manual drive roller, a pair of spaced rollers mounted to the linkage element, a hand crank, and a drive line connecting the manual drive roller, the spaced rollers, and the hand crank.

5. The emergency drive system of claim 4, wherein the linkage element has first and second legs at an obtuse angle to each other.

6. The emergency drive system of claim 5, wherein the angle is about 135°.

7. The emergency drive system of claim 6, wherein the manual drive roller is located on the first leg, one of the spaced rollers is located at a vertex for the first and second legs, and the other spaced roller is located on the second leg.

* * * * *